US007212735B2

(12) United States Patent
Konishi

(10) Patent No.: US 7,212,735 B2
(45) Date of Patent: May 1, 2007

(54) INFRARED RAY LAMP, HEATING APPARATUS USING THE SAME, METHOD FOR MANUFACTURING A HEATING ELEMENT, AND METHOD FOR MANUFACTURING AN INFRARED RAY LAMP

(75) Inventor: Masanori Konishi, Takamatsu (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/960,629

(22) Filed: Oct. 8, 2004

(65) Prior Publication Data

US 2005/0100331 A1 May 12, 2005

(30) Foreign Application Priority Data

Nov. 7, 2003 (JP) ..... 2003-378852

(51) Int. Cl.
*A45D 20/40* (2006.01)

(52) U.S. Cl. ..... 392/407; 392/419

(58) Field of Classification Search ..... None
See application file for complete search history.

(56) References Cited

U.S. PATENT DOCUMENTS 4,469,529 A * 9/1984 Mimura ..... 438/530
5,628,859 A 5/1997 Janin et al.
6,057,532 A 5/2000 Dexter et al.
6,534,904 B1 3/2003 Dieudonné et al.
6,654,549 B1 11/2003 Konishi
2004/0096202 A1* 5/2004 Konishi ..... 392/407

FOREIGN PATENT DOCUMENTS

JP 2001168798 A 6/2001
JP WO 01/41507 A1 6/2001

* cited by examiner

*Primary Examiner*—Thor Campbell
(74) *Attorney, Agent, or Firm*—Pearne & Gordon LLP

(57) ABSTRACT

The present invention provides an infrared ray lamp and a heating apparatus using that infrared ray lamp, a method of manufacturing a heating element and a method of manufacturing an infrared ray lamp, in which radiation range in the longitudinal direction of an infrared ray lamp is either widened than the length of a heating element and carries out heating uniformly, or narrowed than the length of the heating element and increases the radiation intensity to carry out heating locally. Infrared ray lamp of the present invention has: a curved glass tube which has a form that extends in longitudinal direction, its crossing angle of the tangent lines of both ends along that longitudinal direction being 2 degrees or more; and a single or a plurality of heating elements which are sealed in the glass tube and has a flexibility to curve around the glass tube.

16 Claims, 12 Drawing Sheets

INFRARED RAY LAMP, HEATING APPARATUS USING THE SAME, METHOD FOR MANUFACTURING A HEATING ELEMENT, AND METHOD FOR MANUFACTURING AN INFRARED RAY LAMP

BACKGROUND OF THE INVENTION

The present invention relates to an infrared ray lamp for use in a heating apparatus such as a heater or a cookware, a heating apparatus using the same, a method for manufacturing a heating element which comprises the same, and a method for manufacturing an infrared ray lamp, and specifically, relates to an infrared ray lamp using a carbonaceous matter as the heating element and having a superb function as a heat source, a heating apparatus using the infrared ray lamp, a method for manufacturing a heating element, and a method for manufacturing an infrared ray lamp.

Conventional infrared ray lamp has a heating element inserted in a quartz glass tube, wherein heating element is fabricated by forming a resistive element of metal of a nichrome (Ni, Cr, Fe) wire or a tungsten (W) wire in a spiral shape to be heated in the air or in an atmosphere to emit heat directly or with a reflector plate. Since the spiral-fabricated heating element has a uniform radiation intensity distribution, it was not suitable for heating in specific directions. Furthermore, since the spiral-fabricated heating element is hollow inside, it has a gap space between spiral wires, and heat is radiated inside in vain, and hence the spiral heating element required a wasteful energy for extra heating.

Thereupon, in substitution for the conventional spiral-fabricated heating element, an infrared ray lamp having carbonaceous matter as the heating element, wherein carbonaceous matter is formed in plate shape, is disclosed in the international publication WO 01/041507 pamphlet. Since the infrared ray emissivity is as high as 78–84% in carbonaceous matter, using carbonaceous matter as the heating element leads to the rise of infrared ray emissivity of the infrared ray lamp. A plate-shaped heating element has major features such as needlessness of energy for extra heating.

An infrared ray lamp, in which a sintered body of carbonaceous matter formed in a plate shape is used as a heating element and is inserted in a cylindrical quartz glass tube, has a significant radiation intensity and can perform heating with directivity when its cross-sectional shape of carbonaceous heating element is at a rate of 1 to 5 or more.

Furthermore, a desired radiation intensity distribution can be obtained by forming a reflection film evaporated onto a glass tube or a reflector plate which is hemicylindrical and has a mirror-finished reflecting surface in its inner surface. A reflection film or a reflector plate reflects infrared rays radiated from a heating element, and enables to locally increase the radiation intensity.

Since the conventional infrared ray lamp described in the international publication WO 01/041507 pamphlet is configured of a linear heating element and a linear quartz glass tube, longitudinal radiation range of the infrared ray lamp is determined by the length of the heating element. Therefore, even though radiation intensity can be locally increased or diffused in a direction perpendicular to the longitudinal direction of the heating element by using a reflection film or a reflector plate, the conventional infrared ray lamp could neither enlarge radiation range nor increase radiation intensity locally in a longitudinal direction of the heating element.

The present invention is devised in order to solve the above-mentioned problem, and aims to provide an infrared ray lamp having a wide radiation range in the longitudinal direction of a heating element. The present invention aims to provide an infrared ray lamp having a locally strong radiation intensity within a narrow radiation range in the longitudinal direction of a heating element, a heating apparatus using the same, and method for manufacturing a heating element and method for manufacturing an infrared ray lamp.

BRIEF SUMMARY OF THE INVENTION

In order to solve the above-mentioned problems, the present invention has the following constitution.

An infrared ray lamp in accordance with the present invention comprises: a curved or arc-shaped glass tube which has a form that extends in longitudinal direction or along the arc, the crossing angle of the tangent lines to both ends that longitudinal direction or arc being 2 degrees or more; and a single or a plurality of heating elements which are sealed in the above-mentioned glass tube and has a flexibility to curve around the arc-shape of the above-mentioned glass tube.

By curving the heating element convexly, the present invention can realize an infrared ray lamp having a radiation range which is wider than the length of the heating element, in the longitudinal direction or along the arc-shape of the heating element.

By curving the heating element concavely, the present invention can realize an infrared ray lamp having locally strong radiation intensity within a narrower radiation range than along the length of the arc of the heating element.

In the infrared ray lamp in accordance with the present invention from another aspect, the above-mentioned glass tube curves convexly. Due to such structure, the present invention can realize an infrared ray lamp having a radiation range which is wider than the length of the heating element, along arc or in longitudinal direction of the heating element.

In the infrared ray lamp in accordance with the present invention from another aspect, the above-mentioned glass tube curves concavely. Due to such structure, the present invention can realize an infrared ray lamp having locally strong or concentrated radiation intensity within a narrower radiation range than the length of the heating element, in the longitudinal direction of the heating element.

In the infrared ray lamp in accordance with the present invention from still another aspect, the above-mentioned glass tube curves so that the crossing angle of the tangent lines to both ends along the arc or in the longitudinal direction is 90 degrees or under. For example, a heating apparatus, in which infrared ray lamp of the present invention is located so that one end (lower end) is perpendicular to the floor and the other end (upper end) faces upward to the ceiling, heats the floor to the ceiling in a predetermined direction.

By setting a reflector plate or a reflection film concavely, heat does not escape towards the rear. Furthermore, by moving the infrared ray lamp within a predetermined angular range around an axis perpendicular to the floor, such heating apparatus can widely heat the area in the predetermined range of a room and from the floor to the ceiling.

In the infrared ray lamp in accordance with the present invention from still another aspect, the above-mentioned heating element is formed in a plate-shaped form, and the part where the surface of the largest dimension (e.g. width) of the above-mentioned heating element is curved convexly or concavely. Then, the heating element has, within the space perpendicular to the longitudinal direction, a strong radiation intensity distribution characteristic (strong directivity) in the direction perpendicular to the part of the largest dimension.

Accordingly, in regard to infrared ray lamp of the present invention, due to the capability to give directivity to both the surface perpendicular to the longitudinal direction and the longitudinal direction, an infrared ray lamp having a locally strong radiation intensity within a narrow space which is roughly perpendicular to the longitudinal or arc-shaped direction, or an infrared ray lamp having a strong directivity within a space which is roughly perpendicular to the longitudinal or arc-shaped direction, and having a diffused radiation intensity distribution characteristic in the longitudinal direction can be realized.

Preferably, the heating element is configured of a carbonaceous heating element, and the width of the surface whereat its dimension is the largest is 5 times or greater than its thickness.

In the infrared ray lamp in accordance with the present invention from still another aspect, the cross section of the above-mentioned heating element has a rectangular ring shape and the surface having the largest width of the above-mentioned heating element is in a plane surface perpendicular to the central axis of the ring. In other words, the above-mentioned heating element has a plate-shaped form, and curves so that the surface having the largest area lies approximately on the same surface. For example, a plane shape heating element is bent in an arc shape having a predetermined central angle; and fixed in a glass tube to form an infrared ray lamp.

Thereby, an effectively high directivity (strong radiation intensity distribution) in infrared ray can be obtained in the direction parallel to the central axis C of the ring.

In the infrared ray lamp in accordance with the present invention from still another aspect, the above-mentioned heating element has a side surface shape of a circular truncated cone. In other words, the above-mentioned heating element has a plate-shaped form, and the surface which includes the curving outer circumference end of the above-mentioned heating element and the surface which includes the curving inner circumference end of the above-mentioned heating element differ in height.

For example, after forming the heating element in a planar arc having a first central angle (smaller than 360 degrees), the heating element is curved to have a second central angle which is larger than the first central angle (smaller than 360 degrees) and fixed to a glass tube to form an infrared ray lamp.

Thereby, the surface which includes the curving outer circumference end of the heating element and the surface which includes the curving inner circumference end of the heating element differ in height (surface which includes the inner circumference end becomes higher (or lower) than the surface which includes the outer circumference end at the time of assembly).

Heating element of an infrared ray lamp which is configured as such has a strong radiation intensity of infrared ray at an intersecting point "e" of the line "c" which runs through the center of its arc and the line "d" perpendicular to its inclined plane.

The present invention realizes an easy-to-make infrared ray lamp which heats by concentrating heat to specific area. The present invention is useful, for example, for a heating apparatus for heating local areas, heating apparatus for permanent wave at a beauty parlor, and the like.

The infrared ray lamp in accordance with the present invention from still another aspect further has a reflection film which is set at the outer circumference of the above-mentioned glass tube, and curves around its longitudinal direction. Heating element of the infrared ray lamp has, within the surface perpendicular to its longitudinal direction, a strong radiation intensity distribution characteristic (strong directivity) due to reflection film.

In regard to infrared ray lamp of the present invention, due to the capability to give directivity to both the surface perpendicular to the longitudinal direction and the longitudinal direction, an infrared ray lamp having a locally strong radiation intensity, or an infrared ray lamp having a strong directivity within the surface perpendicular to the longitudinal direction and having a diffused radiation intensity distribution characteristic in the longitudinal direction can be realized.

Since the reflection film curves around the heating element in a same radius, the present invention can realize a predetermined directivity with higher precision than installing a reflector plate which is made separately to a glass tube.

The infrared ray lamp in accordance with the present invention from still another aspect further has a reflector plate which is adhered closely to or set at a predetermined distance from the above-mentioned glass tube and curves around its longitudinal direction. Heating element has, within the surface perpendicular to its longitudinal direction, a strong radiation intensity distribution characteristic (strong directivity) due to the reflector plate.

In regard to infrared ray lamp of the present invention, due to the capability to give directivity to both the surface perpendicular to the longitudinal direction and the longitudinal direction, an infrared ray lamp having a locally strong radiation intensity, or an infrared ray lamp having a strong directivity within the surface perpendicular to the longitudinal direction and having a diffused radiation intensity distribution characteristic in the longitudinal direction can be realized.

In the infrared ray lamp in accordance with the present invention from still another aspect, the above-mentioned glass tube has a holding member which holds the above-mentioned heating element at both ends, and the above-mentioned glass tube extends linearly at least in the proximity of the above-mentioned holding member.

Since the glass tube extends linearly in proximity of the holding member, unreasonable stress would not work between the holding member and the heating element at a part where the holding member fixes the heating element, or between the holding member and the glass tube. The infrared ray lamp of the present invention is easy to assemble and has a high reliability.

In the infrared ray lamp in accordance with the present invention from still another aspect, the above-mentioned heating element is made from connecting a plurality of heating elements in cascade, through the intermediary of connecting member. The present invention realizes an infrared ray lamp which is longer than the length of a single heating element.

The present invention can realize an infrared ray lamp of arbitrary length having a radiation range in a longitudinal direction which is wider than the length of the heating element, or an infrared ray lamp of arbitrary length which is longer than the length of a single heating element and having locally strong (i.e. concentrated) radiation intensity.

The infrared ray lamp in accordance with the present invention from still another aspect is characterized in that the above-mentioned heating element is a carbonaceous matter. Heating element which is formed of carbonaceous matter has various features as described below. Since such heating element has a high infrared ray emissivity, when used for heating food, food can be heated in a short time and cooking would taste good.

Since such heating element has a high radiant efficiency, it is also suitable for a heating apparatus which heats by radiation. Since rush current upon energization is small, control circuit may be simple. Since rush current is small, there will be no influence on peripheral devices due to noise. After the power is turned on, such heating element will reach a predetermined temperature in an extremely short time.

The infrared ray lamp of the present invention can be used in a heating apparatus of various purposes, by making good use of these features and characteristic in which the infrared ray lamp has a radiation range which is wider or narrower than the length of the heating element, in the longitudinal direction of the heating element.

In the infrared ray lamp in accordance with the present invention from still another aspect, the above-mentioned heating element is placed at a salient part set inside of the above-mentioned glass tube. According to the present invention, by setting a salient part in the glass tube, the dimension where heating element directly contacts the glass tube wall would be minified, and hence be able to prevent the surface temperature of the glass tube from rising. Thereby life span of the infrared ray lamp is prolonged.

Preferably, salient part is to be set at a side closer to the center of curvature of the curved surface of heating element, and heating element is to be placed at near center of the glass tube. Herewith, heating element can be held stably, and rising of surface temperature of the glass tube can be prevented. Since radius of curvature of the heating element can be maintained in a predetermined value, and since heat is less prone to escape towards the glass tube, radiation efficiency of a heating element improves.

Heating apparatus in accordance with the present invention from still another aspect has the above-mentioned infrared ray lamp. The present invention realizes a heating apparatus having the above-mentioned action.

In the heating apparatus in accordance with the present invention from still another aspect, the above-mentioned infrared ray lamp is rotated through a predetermined angle (it may be 360 degrees), centering on a rotation axis.

For example, a heating apparatus, in which infrared ray lamp of the present invention that has the heating element convexly curved is located so that one end is perpendicular to the floor and the other end faces upward to the ceiling, heats the floor to the ceiling in a predetermined direction. Heat does not escape towards the rear.

By rotating the infrared ray lamp within the predetermined angular range centering on a rotation axis perpendicular to the floor, the present invention can widely heat the predetermined range of a room from the floor to the ceiling.

For example, a heating cookware, in which infrared ray lamp of the present invention that has the heating element concavely curved is held so that infrared ray lamp can rotate in horizontal direction with the concave surface facing upward, concentrates the emission of infrared ray on material to be heated at a place close to directly above the center of longitudinal direction of a heating element, wherein material to be heated is put in proximity of a central axis of rotation which links both ends of the heating element.

Since material to be heated is thoroughly heated not only from directly below but also from a predetermined angle range by rotating infrared ray lamp in a predetermined angle range centering on a rotation axis, material to be heated can be roasted deliciously.

In the heating apparatus in accordance with the present invention from still another aspect, a plurality of the above-mentioned infrared ray lamps which are curved convexly are placed in longitudinal direction of the above-mentioned infrared ray lamp at a predetermined spacing. In other word, the infrared ray lamps are disposed so as to have generally the same tangent lines. In a heating apparatus in which conventional linear infrared ray lamps are located in longitudinal direction at a plurality of predetermined spacings, radiation intensity of infrared ray decreases between the two adjoining infrared ray lamps.

In regard to heating apparatus of the present invention, infrared ray radiation intensity of a central part of an infrared ray lamp and infrared ray radiation intensity between the two adjoining infrared ray lamps can be made the same. The present invention can realize a heating apparatus having an infrared ray radiation intensity distribution characteristic which is uniform in longitudinal direction.

In the heating apparatus in accordance with the present invention from still another aspect, a plurality of the above-mentioned infrared ray lamps which are curved convexly or concavely are placed in parallel at a predetermined spacing.

By placing a plurality of infrared ray lamps which are curved convexly in parallel at a predetermined spacing, the present invention can realize a heating apparatus which uniformly heats an area or a space having a width wider than the length of an infrared ray lamp, and a length of distance between infrared ray lamps at both ends that are placed in parallel.

By placing a plurality of infrared ray lamps which are curved concavely in parallel at a predetermined spacing, the present invention can realize a heating apparatus which uniformly heats an area or a space with a high radiation intensity, wherein the area has a width narrower than the length of an infrared ray lamp, and a length of distance between infrared ray lamps at both ends that are placed in parallel.

In the heating apparatus in accordance with the present invention from still another aspect, a plurality of the above-mentioned infrared ray lamps which are curved convexly or concavely are placed approximately on a single circumference.

By approximately placing a plurality of infrared ray lamps which are curved convexly on a single circumference, the present invention can realize a heating apparatus having uniform infrared ray radiation intensity at approximately 360 degrees on the outer side.

By approximately placing a plurality of the above-mentioned infrared ray lamps which are curved concavely on a single circumference, the present invention can realize a heating apparatus having uniform infrared ray radiation intensity at approximately 360 degrees on the inner side.

The heating apparatus in accordance with the present invention from still another aspect is a heater or a cookware. The present invention realizes a heater or a cookware which carries out heating locally or in wide range by using a curved infrared ray lamp.

A method for manufacturing a heating element in accordance with the present invention from still another aspect comprises an extrusion step for extruding a billet including a carbonaceous matter and curving the extruded member, and a firing step for firing the above-mentioned curved member. By firing the extruded member after it is curved, a heating element which is curved in an arbitrary form can be manufactured inexpensively.

A method for manufacturing an infrared ray lamp in accordance with the present invention from still another aspect comprises a glass tube manufacturing step for manufacturing a linear glass tube, a sealing step for sealing a single or a plurality of heating elements having flexibility in the above-mentioned glass tube, and a curving step for heating and curving the above-mentioned glass tube in which the above-mentioned heating element is sealed. In regard to the present invention, an infrared ray lamp which is curved in a predetermined range can be manufactured inexpensively using a standard heating element, without establishing a process to curve the heating element singly.

A method for manufacturing an infrared ray lamp in accordance with the present invention from still another aspect comprises a glass tube manufacturing step for manufacturing a linear glass tube, a curving step for heating and curving the above-mentioned glass tube, and a sealing step for sealing a single or a plurality of heating elements having flexibility in the above-mentioned glass tube which is curved. In regard to the present invention, an infrared ray lamp which is curved in a predetermined range can be manufactured inexpensively using a standard heating element, without establishing a process to curve the heating element singly.

The method for manufacturing an infrared ray lamp in accordance with the present invention from still another aspect further comprises a salient part forming step for heating the above-mentioned curved glass tube in which a single or a plurality of heating elements having flexibility is sealed, and forming a salient part in the inner side of the above-mentioned glass tube. The present invention, by partially setting a salient part inside the glass tube, can hold the heating element in the center of the glass tube.

While the novel features of the invention are set forth particularly in the appended claims, the invention, both as to organization and content, will be better understood and appreciated, along with other objects and features thereof, from the following detailed description taken in conjunction with the drawings.

Part or all of the drawings are drawn schematically for diagrammatic representation and it should be considered that they do not necessarily reflect relative size and position of components shown therein.

DETAILED DESCRIPTION OF THE INVENTION

Embodiments that specifically show the best mode for conducting the present invention will be described below with reference to figures.

<<First Embodiment>>

Figure 1:
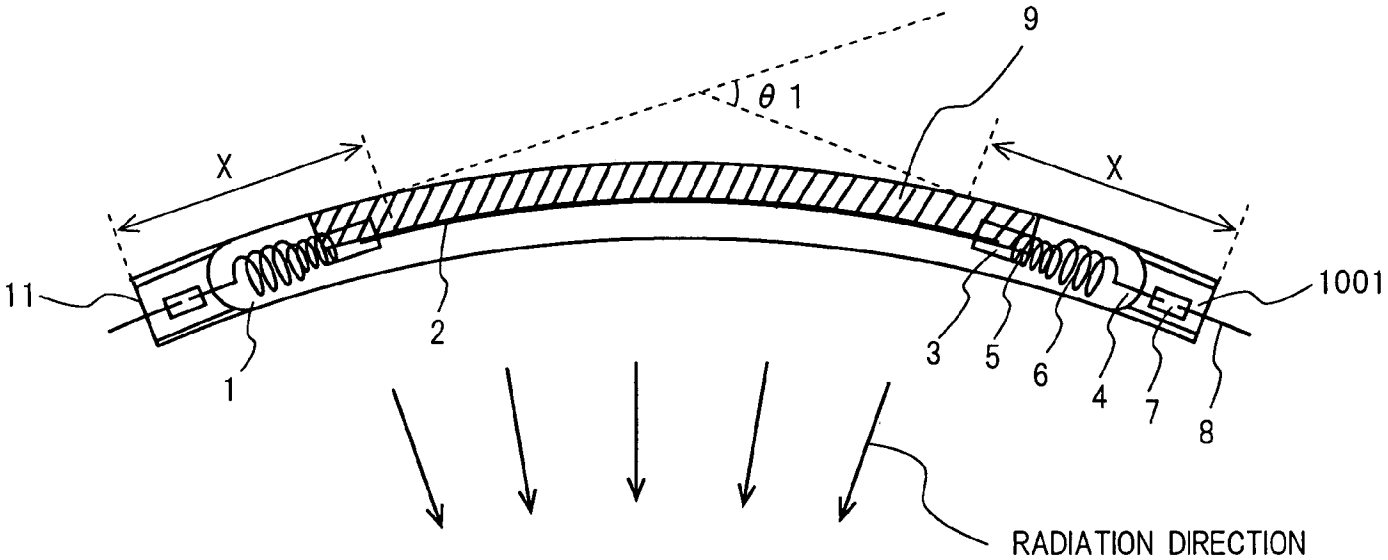
FIG. 1 is a sectional view showing the configuration of an infrared ray lamp in accordance with the first embodiment of the present invention.

Infrared ray lamp, method of manufacturing a heating element, and method of manufacturing an infrared ray lamp in accordance with the first embodiment of the present invention will be described with reference to FIG. 1 and FIG. 12. FIG. 1 is a sectional view showing the configuration of an infrared ray lamp in accordance with the first embodiment of the present invention.

Infrared ray lamp 11 in accordance with the first embodiment of the present invention has a glass tube 1, a heating element 2, radiation blocks 3 mechanically and thermally connected to the heating element 2, internal lead wires 4 each having a coil-shaped part 5 and a spring-shaped part 6 which are electrically connected to the heating element 2, molybdenum foils 7, each of which is sealed in a sealing end stem 1001 of the glass tube 1 and connecting a spring-shaped part 6 and an external lead wire 8, and a reflection film 9 formed on the outer wall of the tube 1.

Figure 12:
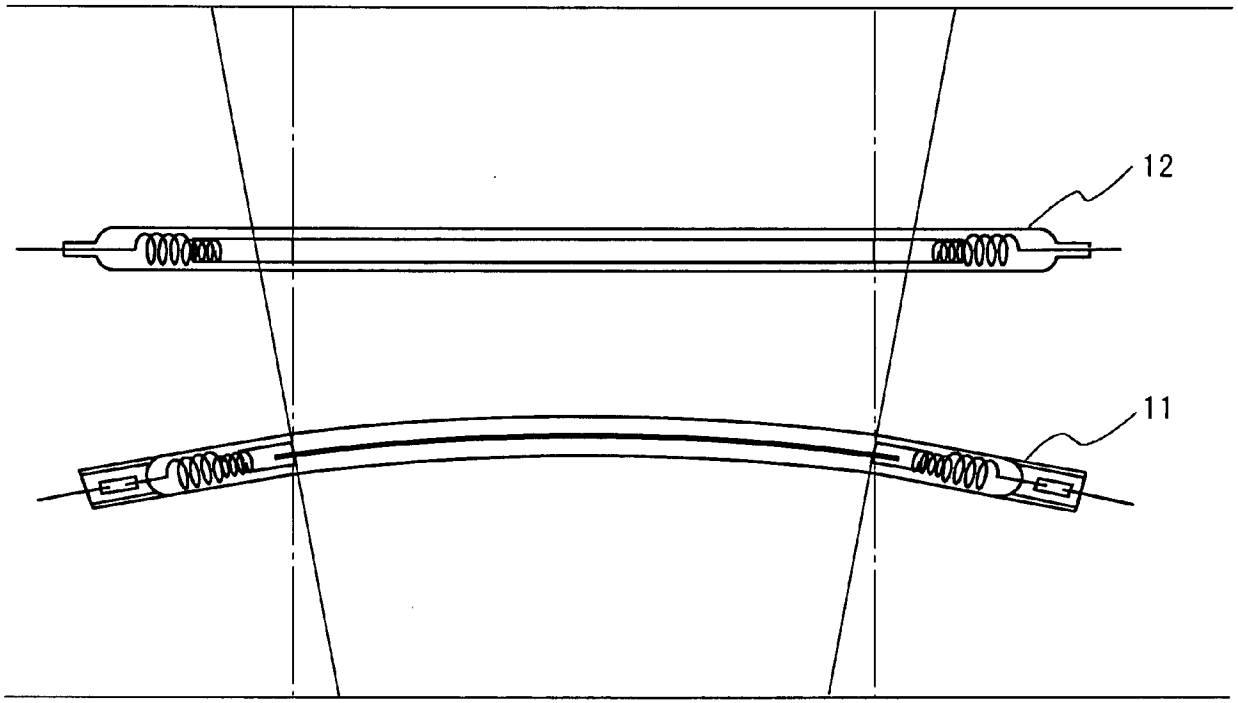
FIG. 12 is a diagram showing the infrared ray lamp of the present invention and the conventional infrared ray lamp.

Difference between the infrared ray lamp of the present invention over the conventional infrared ray lamp is shown in FIG. 12. In the conventional infrared ray lamp 12, a plate-shape-d heating element is sealed in a linear glass tube, whereas in the infrared ray lamp 11 of the present invention, a heating element having flexibility is sealed in a glass tube which is curved concavely or convexly.

Glass tube 1 is an amorphous glass such as a quartz glass or a heat-resistant glass. Glass tube 1 encloses the heating element 2, the radiation blocks 3 and the internal lead wires 4. In regard to the embodiment, the size of a glass tube is 10.5 mm in diameter.

Plate shaped heating element 2 which is enclosed in glass tube 1 is formed from a carbonaceous matter consisting of a mixture of crystallized carbon such as graphite, a resistance value regulatory substance and amorphous carbon. The heating element 2 is plate-shaped, and for example, it is formed to width T=6 mm, thickness t=0.5 mm, and length L=300 mm. By setting $T \geqq 5t$, a radiation intensity distribution characteristic having a strong directivity in the direction perpendicular to width part of Tmm can be obtained. In the heating element 2, the surface where its dimension is the largest (surface having width T=6 mm) is curved concavely. Alternatively, plate-shaped form may be polygonal shape. Since infrared ray emissivity of a carbonaceous matter is as high as 78–84%, using carbonaceous matter as the heating element leads to the rise of infrared ray emissivity of an infrared ray lamp. Furthermore, being a plate-shaped heating element has major features such as needlessness of energy for extra heating for hollow. Since carbonaceous matter has either a slightly negative or a positive characteristic in temperature-resistance characteristic indicating relation between temperature and resistance, rush current upon energization is small, and control circuit may be simple. Since rush current is small, there will be no influence on peripheral devices due to noise.

Radiation block 3 is formed of electrically and thermally conductive materials, and electrically connected to one end of heating element 2. Parenthetically, radiation block 3 may be omitted when calorific value of a heating element is of low-power.

In regard to internal lead wire 4, coil shaped part 5 is formed on one end, and spring shaped part 6 having elasticity is formed subsequently to the coil shaped part 5. As shown in FIG. 1, coil shaped part 5 of internal lead wire 4 adheres closely to and winds around outer circumference surface of radiation block 3, and is electrically connected. Spring shaped part 6 of internal lead wire 4 is located at a predetermined spacing from the outer circumference of radiation block 3, and configured so as to adjust dimensional variation due to expansion of heating element 2.

In FIG. 1, spring shaped part 6 is set at either end, but in the case where infrared ray lamp is disposed vertically, spring shaped part is set at only one end, and the end having the spring shaped part 6 is disposed on the downside.

Molybdenum foil 7 is welded and connected to the other end of each internal lead wire 4. Molybdenum wire which is an external lead wire 8 is welded to each molybdenum foil 7 by spot-welding method. Internal lead wire 4 is connected to external lead wire 8 through molybdenum foil 7.

When a voltage is applied across the external lead wires 8, current flows through the heating element 2, and heat is generated by resistance of the heating element 2 to that current. Thereupon, infrared ray is radiated from the heating element 2. The infrared ray lamp is designed to be in a stationary state when heating temperature of heating element 2 is 1500 degrees or under.

Reflection film 9 can be provided by transferring a gold foil which has a high reflectivity onto the outer surface of glass tube 1, followed by firing the foil. Reflection film 9 is applied on the outer wall of glass tube 1 in the direction opposing the width surface of the heating element 2 (in the direction of the center curved line of the heating element 2). Width of reflection film 9 is approximately half the diameter of the glass tube 1, and length of reflection film 9 is about the length which covers the length of light emission of heating element 2. Reflection film, though it depends on film thickness, reflects approximately 70% of infrared ray radiated from a heating element. And infrared ray from the heating element 2 practically would not transmit through the reflection film.

Parenthetically, though the present invention has been described with an embodiment which uses gold film as the reflection film, it is not restricted to only gold, but metallic materials having high infrared-reflectivity such as silver, aluminum, stainless steel, and nickel, or materials having a considerably high infrared reflectivity such as titanium nitride or alumina oxide, in which layer of reflective surface would at least be formed or be formed with a pasty material, are applicable. Infrared ray reflectivity improves depending on the film thickness; and the thicker the reflection film is, the better the reflectivity.

Method for manufacturing infrared ray lamp 11 which is configured as above-mentioned will be described.

Plate shaped carbonaceous heating element 2 formed from a sintered body which includes carbonaceous matter has flexibility. Making use of this, the present invention manufactures an infrared ray lamp having a curving characteristic. Initially, a linear glass tube 1 is manufactured (glass tube manufacturing step). A heating element 2 is inserted in the transparent linear glass tube 1, and after inert gas preferably argon gas is filled inside, the end of glass tube 1 which includes molybdenum foil 7 is fused and sealed by crushing into a plate shape (sealing step). Direction of pressing for sealing the glass tube may be parallel to the surface where the width of heating element is wide. Alternatively, it may be perpendicular to said surface. Glass tube 1 in which heating element 2 is sealed is heated and curved (curving step).

Because the glass tube 1 is curved after undergoing a conventional manufacturing process as described above (glass tube manufacturing step and sealing step), an infrared ray lamp of the present invention can be manufactured at a low cost.

In substitution for the above-mentioned method of manufacturing an infrared ray lamp, following methods may be used. A billet which includes a carbonaceous matter straightforward is extruded to produce a straight heating element (extrusion step). The straight heating element is then fired (firing step). The heating element which was thus produced has flexibility. A linear glass tube is manufactured (glass tube manufacturing step). The glass tube is then heated and bent into arc shape (curving step). A single or a plurality of heating elements having flexibility are sealed into the curved glass tube (sealing step).

In substitution for the above-mentioned method of manufacturing an infrared ray lamp, following methods may be used. A billet which includes a carbonaceous matter is extruded (extrusion step), and the extruded heating element is bent (or curved). The curved heating element is fired (firing step). A linear glass tube is manufactured (glass tube manufacturing step). The glass tube is then heated and bent into arc shape (curving step). A single or a plurality of curved heating elements are sealed into the curved glass tube (sealing step). This manufacturing method is suitable for, for example, method for manufacturing an infrared ray lamp having a high curvature in accordance with the sixth embodiment or the seventh embodiment.

The infrared ray lamp 11 extends linearly from around the radiation block 3 towards the end (x), and curves at a part where heating element 2 is present. In regard to the curve, crossing angle θ1 of the tangent lines to both ends along the longitudinal direction of the infrared ray lamp is to be 2 degrees or more and 90 degrees or less. Since glass tube 1 linearly extends in proximity of the radiation block 3, unreasonable stress does not work between radiation block 3 and heating element 2 at a part where radiation block 3 fixes the heating element 2, or between radiation block 3 and glass tube 1.

In FIG. 1, infrared ray lamp 11 curves concavely, and has a reflection film 9 on its rear surface (outside of the concave curve). Thereby, infrared ray emitted from heating element 2 is radiated in a direction which concentrates inward.

<<Second Embodiment>>

Figure 2:
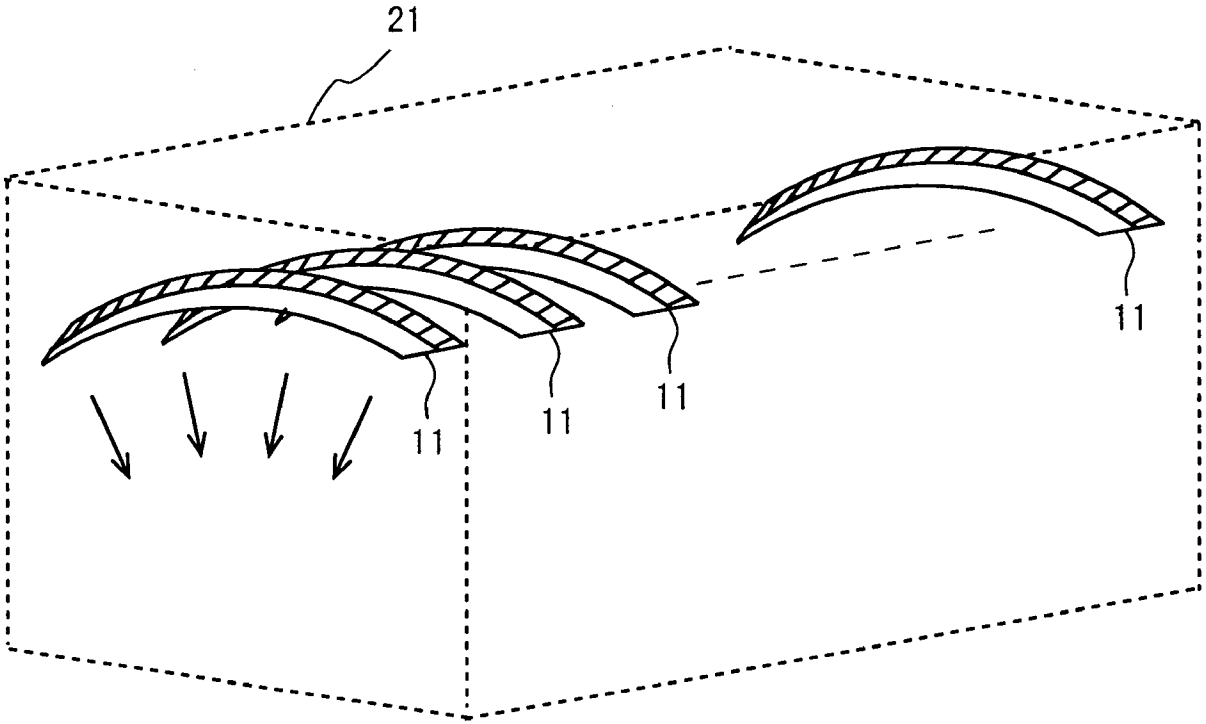
FIG. 2 is a diagram showing the schematic configuration of a heating apparatus in accordance with the second embodiment of the present invention.

Heating apparatus in accordance with the second embodiment of the present invention will be described with reference to FIG. 2. FIG. 2 is a diagram showing the configuration of a heating apparatus in accordance with the second embodiment. In this embodiment, a plurality of concavely curved infrared ray lamps of FIG. 1 are disposed generally in parallel at a predetermined spacing. Infrared ray lamp 11 is placed in the upper part of the heating apparatus, and materials to be heated is placed in the lower part. Since infrared ray lamp 11 radiates infrared ray locally in a narrow range in the longitudinal direction of heating element 2, materials to be heated, which are placed in the lower part of the heating apparatus, can be heated efficiently in a short time.

Parenthetically, the infrared ray lamp may be installed, sequentially changing the installation angle of infrared ray lamp.

In substitution for the configuration of the second embodiment, the present invention can realize a heating apparatus in which a plurality of convexly curved infrared ray lamps (exemplified in FIG. 3 ) are disposed generally in parallel at a predetermined spacing. Due to such configuration, the present invention can realize a heating apparatus which uniformly heats an area having a width wider than the length of an infrared ray lamp, and a length of distance between infrared ray lamps at both ends that are placed in parallel.

<<Third Embodiment>>

Figure 3:
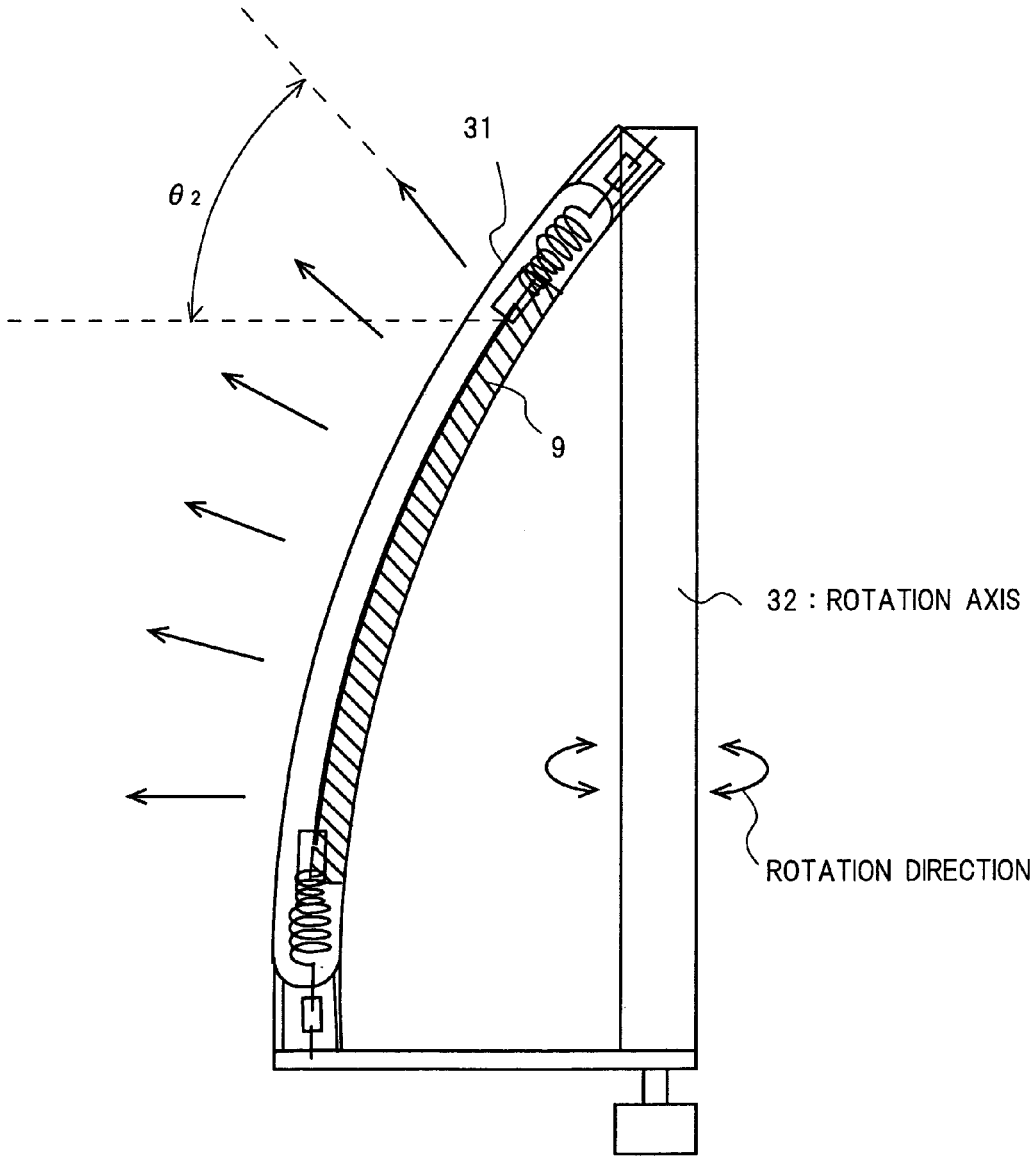
FIG. 3 is a sectional view showing the schematic configuration of a heater in accordance with the third embodiment of the present invention.

Heating apparatus in accordance with the third embodiment of the present invention will be described with reference to FIG. 3. Heating apparatus in accordance with the third embodiment is an electrical stove. FIG. 3 is a diagram showing the schematic configuration of an electrical stove in accordance with the third embodiment of the present invention, which uses an infrared ray lamp that is curved convexly. In regard to infrared ray lamp 31 of FIG. 3, the location of reflection film 9 differs from that of infrared ray lamp 11 that is curved concavely as shown in FIG. 1. In FIG. 3, infrared ray lamp 31 curves convexly, and has a reflection film 9 on its rear surface. Glass tube is curved so that the crossing angle of the tangent lines to both ends along that longitudinal direction is 90 degrees or less. In regard to the heating element, the surface where its dimension is the largest is curved convexly. Thereby, infrared ray which is emitted from heating element 2 is radiated in a direction expanding outward. In regard to an electrical stove in accordance with the third embodiment, infrared ray lamp 31 is located so that one end becomes perpendicular to the floor, while the other end faces upward to the ceiling. Heat does not escape towards the rear. Infrared ray lamp 31 of the present invention, in comparison with the conventional linear infrared ray lamp, can heat a wide range from a direction parallel to the floor to a direction facing the ceiling (range which is only wider in upward direction for elevation angle (angle with resect to the horizontal direction) of the line perpendicular to the tangent line to the other end of infrared ray lamp 31=θ2).

Furthermore, by rotating infrared ray lamp 31 through a predetermined angle (360 degrees in the embodiment) centering on rotation axis 32, the present invention can heat a still wider range.

The present invention can realize a heating cookware in which infrared ray lamp in accordance with the first embodiment with concavely curved heating element is held such that infrared ray lamp can rotate in horizontal direction with the concave surface facing upward. In regard to this heating cookware, infrared ray is emitted in concentration on material to be heated at a place close to directly above the center of longitudinal direction of a heating element, wherein material to be heated is put in proximity of a central axis of rotation which links both ends of the heating element. Since material to be heated is thoroughly heated not only from directly below but also from a predetermined angle range by rotating infrared ray lamp in a predetermined angle range centering on a rotation axis, material to be heated can be roasted deliciously.

<<Fourth Embodiment>>

Figure 4:
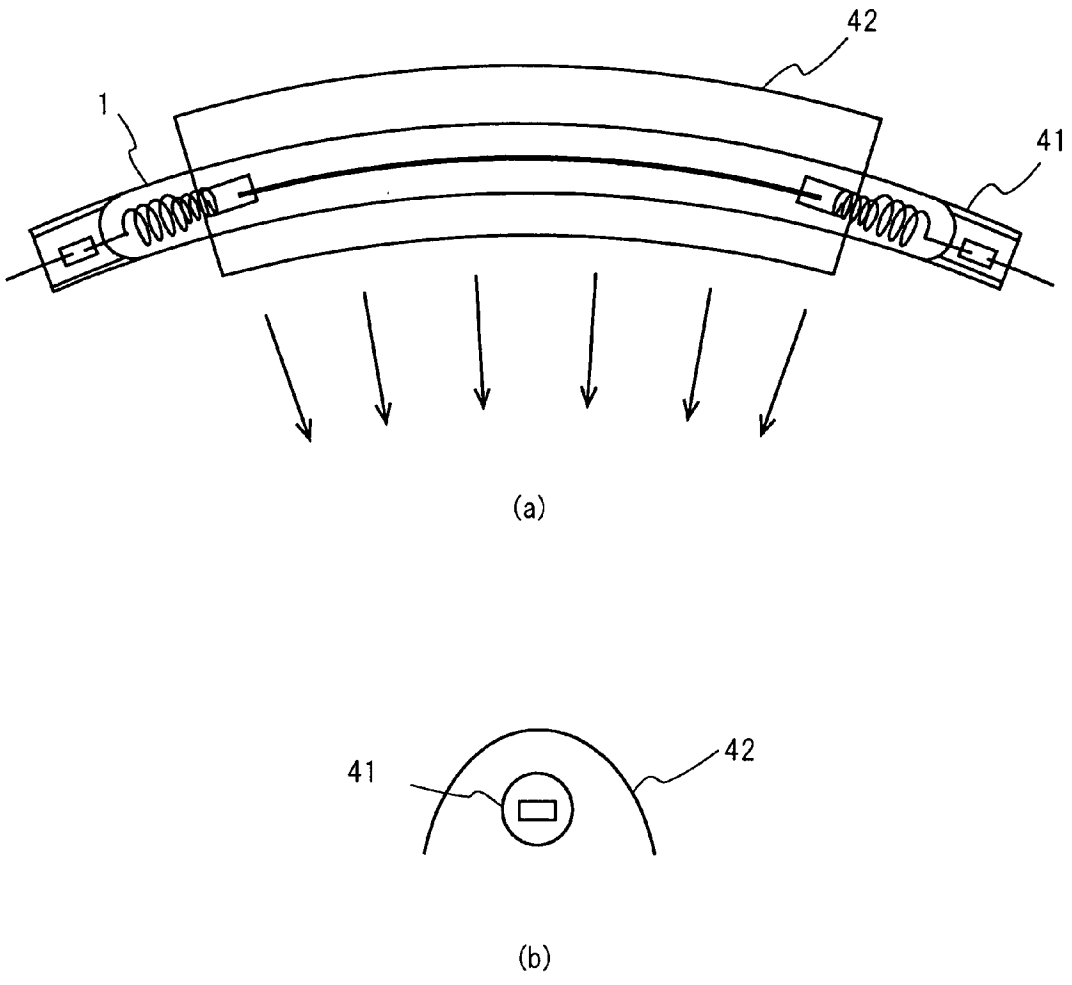
FIG. 4 is a sectional view showing the configuration of an infrared ray lamp in accordance with the fourth embodiment of the present invention.

Infrared ray lamp in accordance with the fourth embodiment of the present invention will be described with reference to FIG. 4. Part (a) of FIG. 4 is a sectional view which includes the centerline along the longitudinal direction of an infrared ray lamp in accordance with the fourth embodiment, and part (b) of FIG. 4 is a sectional view at center part which is perpendicular to the longitudinal direction of the infrared ray lamp. Points where infrared ray lamp 41 in FIG. 4 differs from infrared ray lamp 11 in FIG. 1 is that infrared ray lamp 41 has a reflector plate 42 instead of a reflection film 9. Infrared ray lamp 41 installs reflector plate 42 on the rear surface of an infrared ray lamp which is curved concavely. In other points, infrared ray lamp 42 is the same as infrared ray lamp 11. Reflector plate 42 is formed in a parabolic shape. Reflector plate 42 may be installed so as to adhere closely to the glass tube, or it may be installed at a predetermined distance from the glass tube.

Reflector plate 42 is formed from a material having a high infrared ray reflectivity preferably aluminum. Besides aluminum, gold, titanium nitride, silver, or stainless steel, formed in a parabolic shape, and has a reflecting surface wherein its inner surface is mirror-finished. Infrared ray reflectivity of the reflector plate is approximately 80% to 90%.

In regard to the cross section which is perpendicular to the central axis of glass tube 1, the cross-sectional shape of reflector plate 42 closely resembles a parabola wherein central axis of the glass tube is the focal point. By focal point of parabola, it is meant that a point where light emitted from the point source of light located at the focal point, is reflected by parabola face, and turns into a parallel light. The centerline which expands in the longitudinal direction of reflector plate 42 is perpendicular to the surface where width of a heating element is the widest, and approximately runs through the surface which runs through the centerline extending in the longitudinal direction. Reflector plate 42 has a length to cover the range of light emission of heating element 2.

Infrared ray lamp 41 which uses a reflector plate of FIG. 4 bears the same effect as infrared ray lamp 11 which uses a reflection film of FIG. 1.

<<Fifth Embodiment>>

Figure 5:
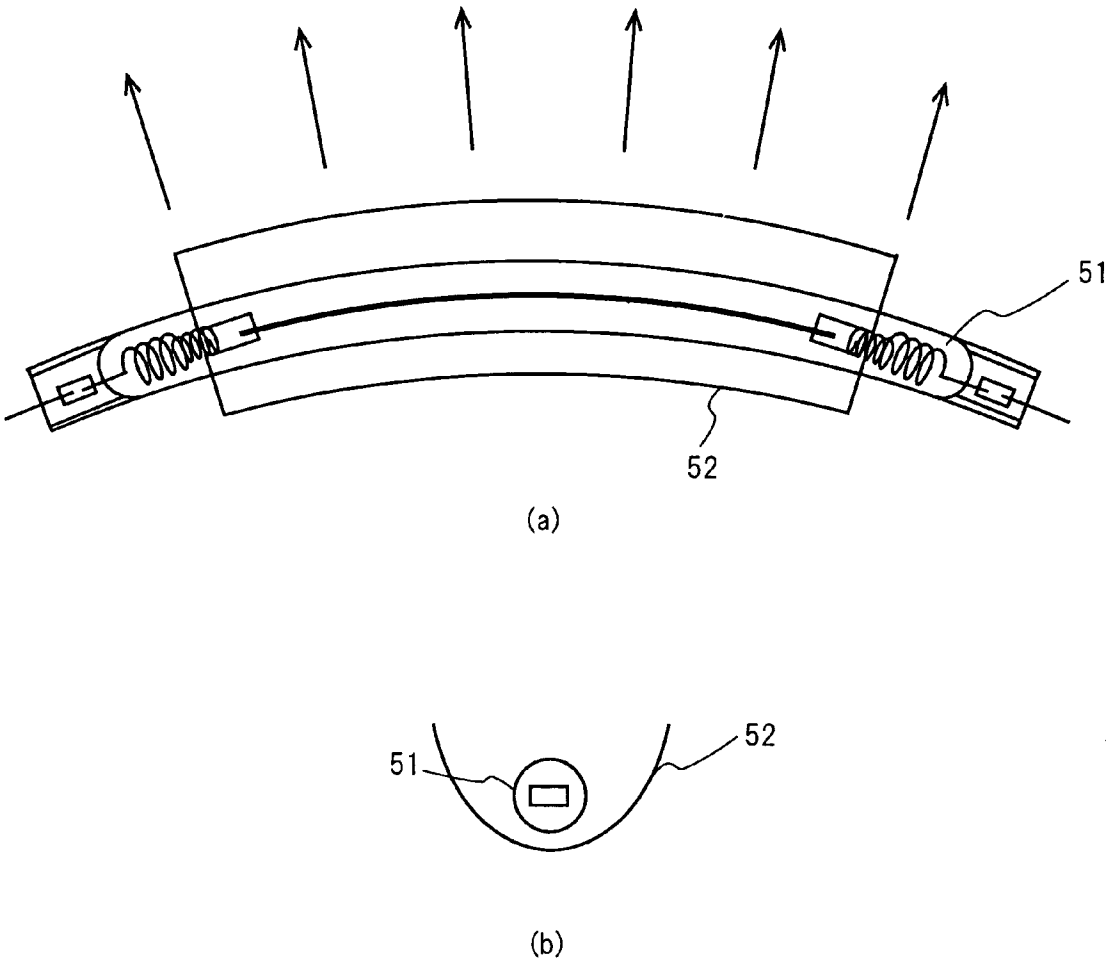
FIG. 5 is sectional view showing the configuration of an infrared ray lamp in accordance with the fifth embodiment of the present invention.

Infrared ray lamp in accordance with the fifth embodiment of the present invention will be described with reference to FIG. 5. Part (a) of FIG. 5 is a sectional view which includes the centerline expanding in the longitudinal direction of an infrared ray lamp in accordance with the fifth embodiment, and part (b) of FIG. 5 is a sectional view which is perpendicular to the longitudinal direction of the infrared ray lamp. In regard to infrared ray lamp 51 in FIG. 5, the installation position of reflector plate 52 differs from that of FIG. 4. Infrared ray lamp 51 of FIG. 5 installs reflector plate 52 on the rear surface of an infrared ray lamp which is curved convexly, and heats a wide range.

Reflector plate 52 is formed from a material having a high infrared ray reflectivity such as aluminum, gold, titanium nitride, silver, or stainless steel, formed in a parabolic shape, and has a reflecting surface wherein its inner surface is mirror-finished. Infrared ray reflectivity of the reflector plate is approximately 80% to 90%.

In regard to the cross section which is perpendicular to the central axis of glass tube 1, the cross-sectional shape of reflector plate 52 closely resembles a parabola wherein central axis of the glass tube is the focal point. The centerline extending to the longitudinal direction of reflector plate 52 is perpendicular to the surface where width of a heating element is the widest, and approximately runs through the surface which runs through the centerline extending in the longitudinal direction. Reflector plate 52 has a length to cover the range of light emission of heating element 2.

Infrared ray lamp 51 which uses a reflector plate of FIG. 5 bears the same technical effect as infrared ray lamp 31 which uses a reflection film of FIG. 3.

<<Sixth Embodiment>>

Figure 6:
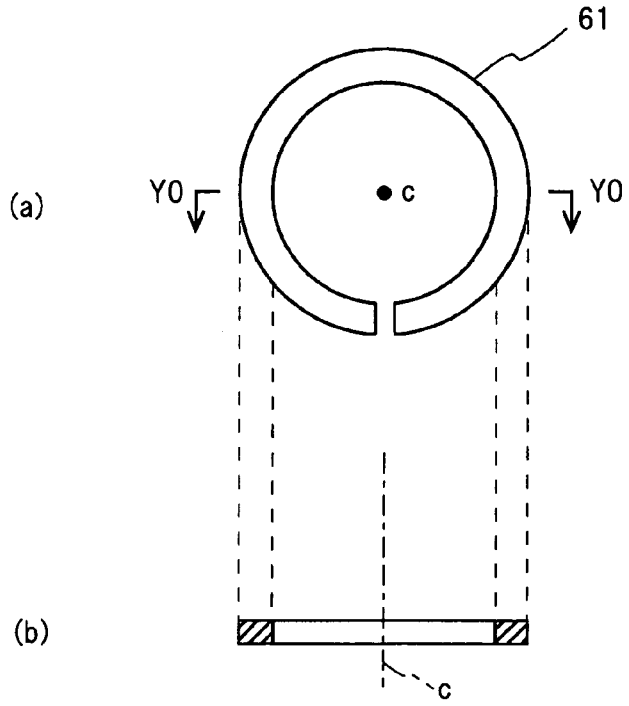
FIG. 6 is a plan view and a sectional view showing the configuration of a heating element which the infrared ray lamp in accordance with the sixth embodiment of the present invention has.

Infrared ray lamp in accordance with the sixth embodiment of the present invention will be described with reference to FIG. 6. Part (a) of FIG. 6 is a diagram typically showing a heating element included in the infrared ray lamp in accordance with the sixth embodiment of the present invention has, wherein the heating element is approximately annular, and part (b) of FIG. 6 is its sectional view. Heating element 61 of FIG. 6 has a plate-shaped form, and the surface where dimension is the largest (surface where width is the widest) exists approximately on a same plane surface. Infrared ray lamp is fixed to the radiation block at the part where annulus is open, and furthermore, is sealed in a glass tube. The entire surface where the dimension of heating element 61 is the largest is formed in a narrower area compared with the length of a linear heating element (in the sixth embodiment, the narrow area is mostly encompassed with a heating element). Thereby, a high directivity (strong radiation intensity distribution characteristic) in infrared ray can be obtained effectively in the direction perpendicular to a narrow area where the surface where the dimension of heating element is the largest is formed. Infrared ray lamp in accordance with the sixth embodiment is suitable for, for example, a permanent wave heater.

<<Seventh Embodiment>>

Figure 7:
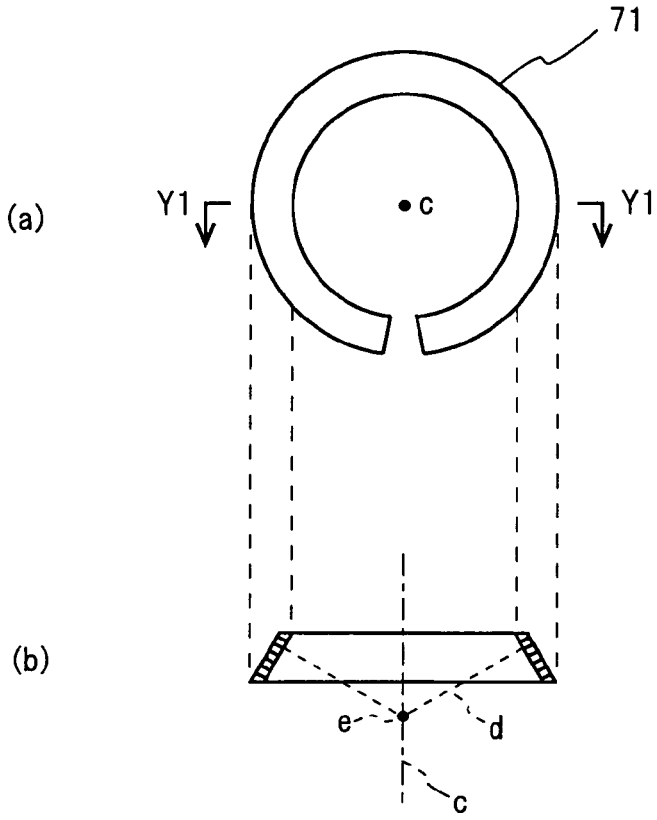
FIG. 7 is a plan view and a sectional view showing the configuration of a heating element which the infrared ray lamp in accordance with the seventh embodiment of the present invention has.

Infrared ray lamp in accordance with the seventh embodiment of the present invention will be described with reference to FIG. 7. Part (a) of FIG. 7 is a diagram typically showing a heating element which the infrared ray lamp in accordance with the seventh embodiment of the present invention has, wherein the heating element is approximately annular. Part (b) of FIG. 7 is its sectional view. Heating element 71 of FIG. 7 has a plate-shaped form, and the surface which includes the curving outer circumference end of a heating element and the surface which includes the curving inner circumference end of the heating element differs in its height. For example, after forming the heating element in an planar arc having a first central angle (smaller than 360 degrees), the heating element is curved to a second central angle which is larger than the first central angle (smaller than 360 degrees) and fixed to a glass tube to form an infrared ray lamp. The surface which includes the inner circumference end becomes higher (or lower) than the surface which includes the outer circumference end at the time of assembly. Heating element of an infrared ray lamp which is configured as such has a strong radiation intensity of infrared ray at an intersecting point of the line which runs through the center of its arc and the line perpendicular to its inclined plane. The present invention realizes an easy-to-make infrared ray lamp which carries out heating by concentrating heat to a specific area. Infrared ray lamp in accordance with the seventh embodiment is still more suitable for, for example, a permanent wave heater.

<<Eighth Embodiment>>

Figure 8:
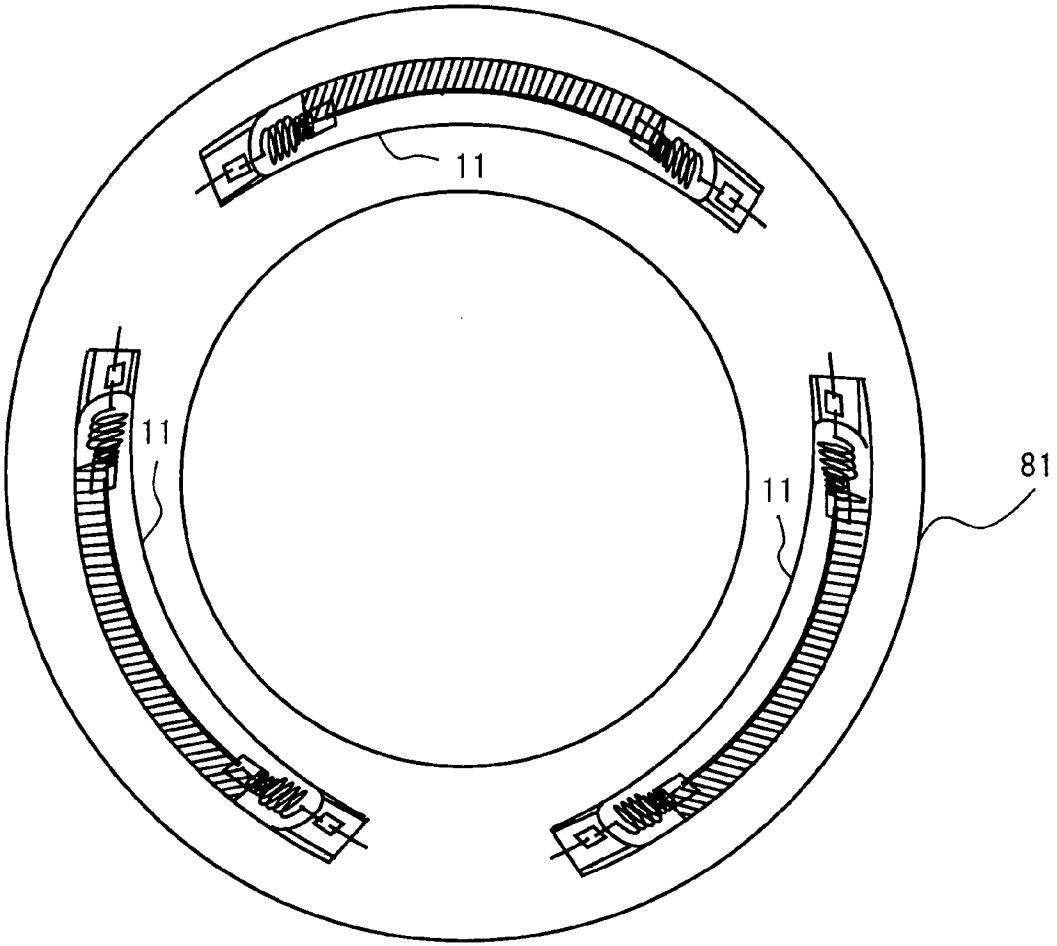
FIG. 8 is a plan view showing the configuration of a heating apparatus in accordance with the eighth embodiment of the present invention.

Infrared ray lamp in accordance with the eighth embodiment of the present invention will be described with reference to FIG. 8. FIG. 8 is a diagram showing the configuration of a heating apparatus in accordance with the eighth embodiment of the present invention. Heating apparatus in accordance with the eighth embodiment 8 has a configuration in which a plurality of infrared ray lamps which are curved concavely as shown in FIG. 1 are placed approximately on a single circumference. Thereby, the present invention can realize a heating apparatus having uniform infrared ray radiation intensity at approximately 360 degrees on the inner side. By altering the direction in which the reflection film is formed, the present invention can make the heating apparatus having a directivity which is in the same direction as that of infrared ray lamp in accordance with the sixth embodiment or the seventh embodiment. Since heating apparatus 81 in accordance with the eighth embodiment uses an infrared ray lamp 11 of FIG. 1 wherein its central angle is small, manufacturing the heating apparatus 81 is easy when compared to that of using an infrared ray lamp of FIG. 6 and FIG. 7 having the central angle of the heating element is large. Heating apparatus 81 is suitable for, for example, permanent wave heater.

In substitution for the eighth embodiment, by approximately placing a plurality of infrared ray lamps which are curved convexly on a single circumference, the present invention can realize a heating apparatus having uniform infrared ray radiation intensity at approximately 360 degrees on the outer side.

<<Ninth Embodiment>>

Figure 9:
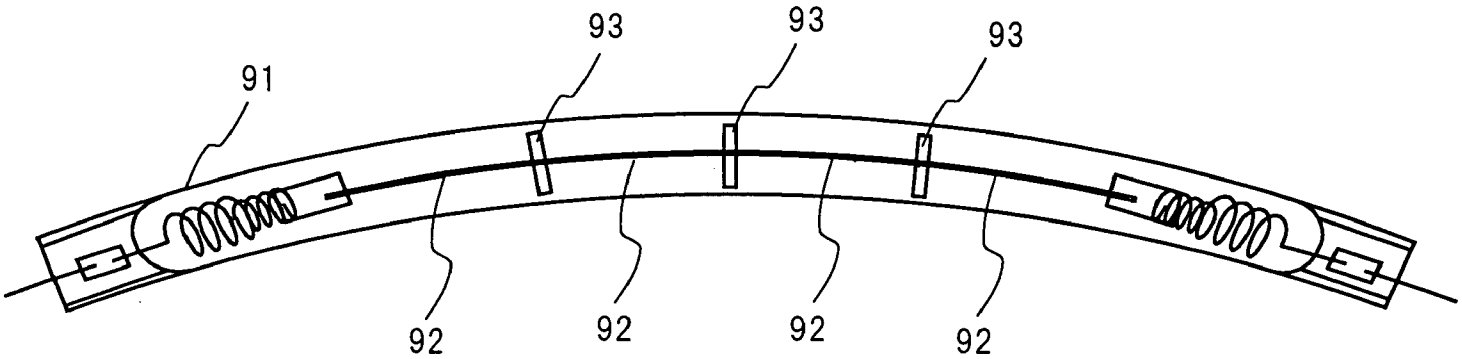
FIG. 9 is a sectional view showing the configuration of an infrared ray lamp in accordance with the ninth embodiment of the present invention.

Infrared ray lamp in accordance with the ninth embodiment of the present invention will be described with reference to FIG. 9. FIG. 9 is a diagram showing the configuration of an infrared ray lamp in accordance with the ninth embodiment of the present invention. Infrared ray lamp in accordance with the ninth embodiment has a configuration in which a plurality of heating elements connected in cascade by means of intermediary of a connecting member is sealed in a glass tube. The plate-shaped heating element 92 formed from a sintered body including carbonaceous matter is connected in cascade through the intermediary of a connecting member 93 which is a conducting material. By connecting a plurality of heating elements 92 in cascade through the intermediary of a connecting member 93, infrared ray lamp 91 is longer than a infrared ray lamp which is configured with a single heating element, and thus a long infrared ray lamp having a still larger curving characteristic can be realized. By using a long infrared ray lamp, heating a wide range or obtaining a strong directivity can be realized.

<<Tenth Embodiment>>

Figure 10:
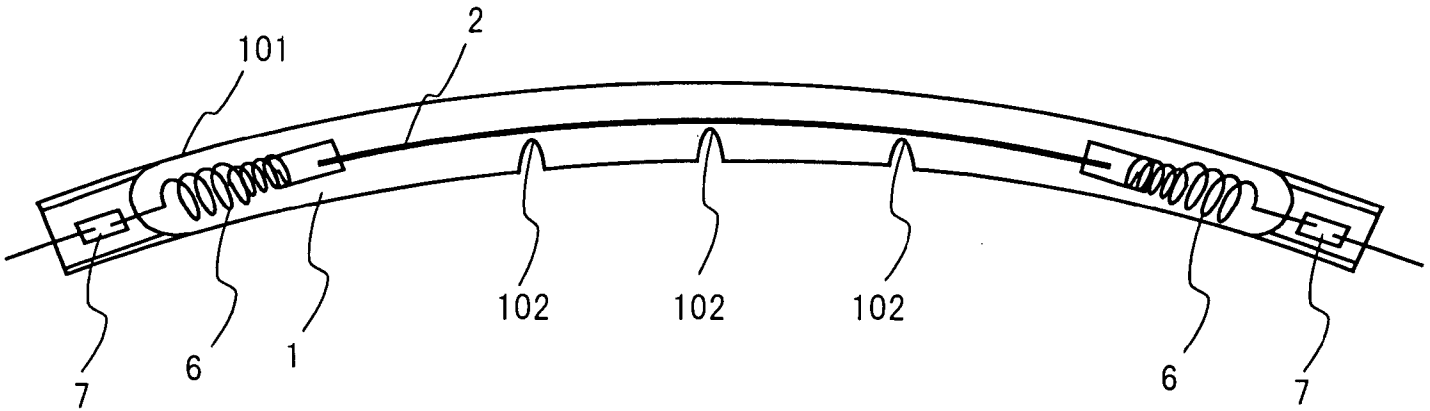
FIG. 10 is a sectional view showing the configuration of an infrared ray lamp in accordance with the tenth embodiment of the present invention.

Infrared ray lamp in accordance with the tenth embodiment of the present invention will be described with reference to FIG. 10. FIG. 10 is a diagram showing the configuration of an infrared ray lamp in accordance with the tenth embodiment of the present invention. The infrared ray lamp in accordance with the tenth embodiment has salient parts in the inner side of a glass tube.

Method of manufacturing an Infrared ray lamp 101 in accordance with the tenth embodiment of the present invention will be described. Initially, a linear glass tube 1 is manufactured (glass tube manufacturing step). Heating element 2 is inserted in the transparent linear glass tube 1, and after inert gas such as argon gas is filled inside, the end of glass tube 1 which includes molybdenum foil 7 is fused and sealed by crushing into a plate shape (sealing step). Direction of sealing the glass tube may be parallel to the surface where the width of heating element is wide, or, alternatively it may be perpendicular to that surface. Glass tube 1 in which heating element 2 is sealed is heated and curved or bent (curving step). Glass tube 1 is partially heated and softened at a single or a plurality of places, and salient parts 102 are formed so as to protrude in the inner side of a glass tube (salient parts forming step). In regard to the tenth embodiment, salient parts 102 are set in three places in the curved surface of a glass tube, at a side that is near to the center of curvature.

Since spring shaped parts 6 having resiliency and positioned at both ends of a heating element 2 pull the heating element to both sides, when there is space between the glass tube 1 and the heating element 2, heating element moves close to the inner wall of a glass tube, to a side that is nearer the center of curvature. In the present invention, heating element can be held roughly in the center part (or along the axial part) of the glass tube by means of the salient part which is set on the inner wall of a glass tube, to a side that is near the center of curvature. Thereby, the areas where heating element 2 directly contacts the glass tube 1 would be minimised, and the surface temperature of the glass tube would not rise, and the service life of the infrared ray lamp is prolonged. Since radius of curvature of heating element 2 can be maintained at a predetermined value, and since heat is less prone to escape towards glass tube 1, radiation efficiency of a heating element 2 improves.

<<Eleventh Embodiment>>

Figure 11:
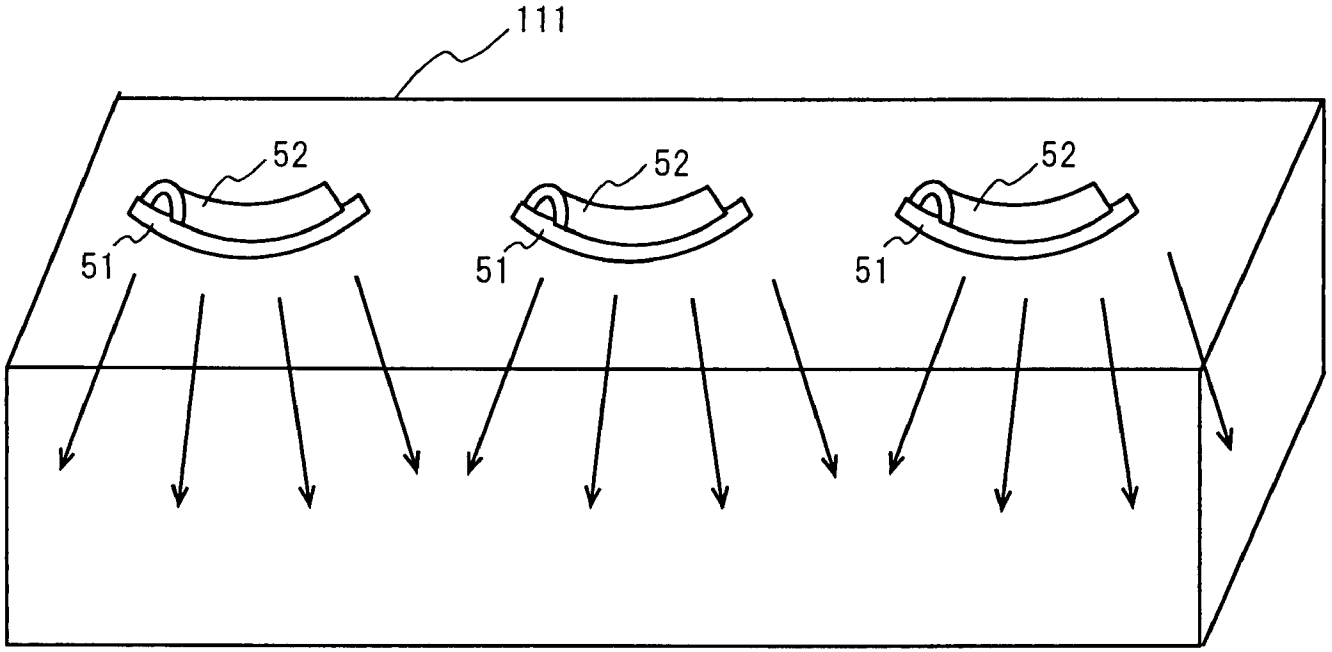
FIG. 11 is a diagram showing the schematic configuration of a heating apparatus in accordance with the eleventh embodiment of the present invention.

Heating apparatus in accordance with the eleventh embodiment of the present invention will be described with reference to FIG. 11. FIG. 11 is a diagram showing the schematic configuration of a heating apparatus in accordance with the eleventh embodiment of the present invention. Heating apparatus in accordance with the eleventh embodiment has a configuration in which a plurality of infrared ray lamps which are curved convexly as shown in FIG. 5 are placed in the longitudinal direction of the infrared ray lamp at a predetermined spacing. Since infrared ray lamp 51 of the present invention has a curving characteristic, it can heat a wider range than the length of heat radiation of a heating element, and can heat spaces or intervals between heating elements. When compared to a heating apparatus using the conventional linear infrared ray lamp, the heating apparatus in accordance with the eleventh embodiment can heat the entire heating apparatus with a fewer number of infrared ray lamps. Heating apparatus 111 of FIG. 11 is suitable for a warmer or the like which uniformly heat or retains heat of object to be heated.

Infrared ray lamp of the present invention can be applied to a heating apparatus which aims to heat a material to be heated with a heat source, such as a heater (for example, a stove, a kotatsu (fireplace with a coverlet), an air conditioner, infrared therapy equipment), a drying machine (for example, a cloth dryer, a bedding dryer, a food dryer, a garbage disposal apparatus, a heating type deodorizer, etc.), a cookware (for example, an oven, an oven and range, a toaster oven, toaster, a roaster, an insulating device, a chicken griller, a cooking stove, a thawing device for refrigerator), a hair dressing device (for example, a hair dryer, a permanent wave heater), or a device for fixating letters or images and so on to a sheet (for example, devices which use toner as a medium to indicate letters and images such as a LBP (laser beam printer), a PPC (plain paper copier), and a facsimile, and devices which thermally transfer letters and images from the original film to the object to transcribe onto using heat).

According to the present invention, an advantageous technical effect capable to realize an infrared ray lamp and a heating apparatus using that infrared ray lamp, a method of manufacturing a heating element and a method of manufacturing an infrared ray lamp can be obtained, in which radiation range in the longitudinal direction of the infrared lamp is widened than the length of a heating element and carries out heating uniformly, or narrowed than the length of the heating element and increases the radiation intensity to carry out heating locally.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

Infrared ray lamp of the present invention is useful as a heating source of a heating apparatus. Heating apparatus of the present invention can be used as a heating apparatus of various purposes. Method of manufacturing a heating element and method of manufacturing an infrared ray lamp of the present invention can be used as a method of manufacturing an infrared ray lamp of the present invention.

The invention claimed is:

1. An infrared ray lamp comprising:

a curved glass tube which has a form that extends in longitudinal direction, the crossing angle of the tangent line parts at both ends along that longitudinal direction being two degrees more; and a single or a plurality of heating elements which are sealed in said glass tube and has a flexibility to curve along said glass tube, wherein said heating element has a plate-shaped form, and is curved such that the surface having the largest width of said heating element is convexly or concavely.

2. An infrared ray lamp according to claim 1, wherein said glass tube curves so that the crossing angle of the tangent line parts at both ends along that longitudinal direction is 90 degrees or under.

3. An infrared ray lamp comprising:

a curved glass tube which has a form that extends in longitudinal direction, the crossing angle of the tangent line parts at both ends along that longitudinal direction being two degrees or more; and a single or a plurality of heating elements which are sealed in said glass tube and has a flexibility to curve along said glass tube, wherein the cross section of said heating element has a rectangular ring shape and the surface having the largest width of said heating element is in a plan surface perpendicular to the central axis of the ring.

4. An infrared ray lamp according to claim 1, further comprising a reflection film which is provided partly on the outer circumference face of said glass tube.

5. An infrared ray lamp according to claim 1, further comprising a reflector plate which is adhered closely to or set with a predetermined distance from said glass tube.

6. An infrared ray lamp according to claim 1, wherein said glass tube extends linearly at both ends.

7. An infrared ray lamp according to claim 1, wherein said heating element is formed by connecting a plurality of heating elements in cascade, through the intermediary of a connecting member.

8. An infrared ray lamp according to claim 1, wherein said heating element is placed on salient parts which are set inside said glass tube.

9. A heating apparatus comprising an infrared ray lamp in accordance with claim 1.

10. A heating apparatus according to claim 9, wherein said infrared ray lamp is rotated, centering on a rotation axis.

11. A heating apparatus according to claim 9, wherein a plurality of said infrared ray lamps which are curved convexly are arranged along longitudinal curve of said infrared ray lamp with predetermined spacings therebetween.

12. A heating apparatus according to claim 9, wherein a plurality of said infrared ray lamps which are curved convexly or concavely are disposed generally in parallel with predetermined spacings therebetween.

13. A heating apparatus according to claim 9, wherein a plurality of said infrared ray lamps which are curved convexly or concavely are disposed along a single circumference.

14. A heating apparatus according to claim 9, wherein the heating apparatus is a room heater or a cookware.

15. An infrared ray lamp according to claim 1, wherein said heating element is a carbonaceous matter.

16. A heating apparatus comprising an infrared ray lamp in accordance with claim 3.

* * * * *